US009533190B2

(12) United States Patent
Walkama

(10) Patent No.: US 9,533,190 B2
(45) Date of Patent: Jan. 3, 2017

(54) EXERCISE CHAIR WITH SPIN SEAT

(71) Applicant: MOXXI, LLC, Newburyport, MA (US)

(72) Inventor: Dorianne P. Walkama, Newburyport, MA (US)

(73) Assignee: MOXXI, LLC, Newburyport, MA (US)

( * ) Notice: Subject to any disclaimer, the term of this patent is extended or adjusted under 35 U.S.C. 154(b) by 334 days.

(21) Appl. No.: 13/913,793

(22) Filed: Jun. 10, 2013

(65) Prior Publication Data

US 2013/0331243 A1 Dec. 12, 2013

Related U.S. Application Data

(60) Provisional application No. 61/658,077, filed on Jun. 11, 2012.

(51) Int. Cl.

| | |
|---|---|
| ***A63B 23/02*** | (2006.01) |
| ***A63B 26/00*** | (2006.01) |
| ***A63B 21/02*** | (2006.01) |
| ***A47C 9/00*** | (2006.01) |
| ***A63B 21/04*** | (2006.01) |
| ***A63B 21/055*** | (2006.01) |
| ***A63B 22/14*** | (2006.01) |
| ***A63B 23/04*** | (2006.01) |
| *A63B 71/00* | (2006.01) |
| *A63B 23/035* | (2006.01) |
| *A63B 21/00* | (2006.01) |

(52) U.S. Cl.

CPC ..... *A63B 26/00* (2013.01); *A47C 9/002* (2013.01); *A63B 21/023* (2013.01); *A63B 21/0421* (2013.01); *A63B 21/0442* (2013.01); *A63B 21/0552* (2013.01); *A63B 21/1609* (2015.10); *A63B 22/14* (2013.01); *A63B 23/03541* (2013.01); *A63B 23/0405* (2013.01); *A63B 21/00072* (2013.01); *A63B 21/4034* (2015.10); *A63B 23/03525* (2013.01); *A63B 71/0036* (2013.01); *A63B 2210/50* (2013.01); *A63B 2225/093* (2013.01)

(58) Field of Classification Search

CPC ..... A63G 13/06; A63G 13/08; A63G 13/10; A63G 31/08; A63G 1/30; A63B 2208/0233; A63B 23/0222; A63B 21/1496; A63B 2023/003

See application file for complete search history.

(56) References Cited

U.S. PATENT DOCUMENTS 2,971,758 A * 2/1961 Zimmers ..... A63G 13/08 446/325
3,768,808 A * 10/1973 Passera ..... A63B 21/012 482/114
4,379,550 A * 4/1983 Petersen ..... 472/104

(Continued)

*Primary Examiner* — Loan H Thanh
*Assistant Examiner* — Rae Fischer
(74) *Attorney, Agent, or Firm* — McLane Middleton, Professional Association

(57) ABSTRACT

An exercise chair includes a frame and a seat rotatably coupled to the frame. First and second front support members are coupled to the frame in laterally spaced part relation and first and second rear support members are coupled to the frame in laterally spaced part relation, the first and second front support members and the first and second rear support members cooperating to support the frame above a surface.

19 Claims, 15 Drawing Sheets

(56) References Cited

U.S. PATENT DOCUMENTS

| | | | | |
|---|---|---|---|---|
| 6,533,354 | B2 * | 3/2003 | Ko | A47C 3/18 297/344.21 |
| 7,081,075 | B2 * | 7/2006 | Sachs | A63B 69/0093 482/146 |
| 7,608,030 | B2 * | 10/2009 | Splane | A63B 21/1492 482/140 |
| 7,794,378 | B2 | 9/2010 | Splane, Jr. et al. | |
| 7,998,045 | B2 | 8/2011 | Splane | |
| 8,007,423 | B2 * | 8/2011 | Solow | A63B 21/023 482/142 |

* cited by examiner

EXERCISE CHAIR WITH SPIN SEAT

CROSS-REFERENCE TO RELATED APPLICATION

This application claims priority to U.S. Provisional Application No. 61/658,077 filed Jun. 11, 2012. The aforementioned application is incorporated herein by reference in its entirety.

BACKGROUND

The present disclosure relates generally to exercise equipment and, in particular, to an improved exercise chair which may be used to perform not only exercises typically performed on a conventional Pilates chair, but also to perform exercises which are not performed on a conventional Pilates chair, including Reformer-based exercises and others, including exercises that cannot be performed on Pilates chairs having a fixed seat.

Pilates is a physical fitness training method developed by Joseph Pilates in the early 20th century. The Pilates method is a non-impact exercise technique incorporating principles of yoga and which focuses on spinal and pelvic alignment, core strengthening and controlled movements. The Pilates method includes many exercises to be performed on a mat, as well as many exercises to be performed on specialized pieces of equipment. For example, the so-called Wunda Chair includes a fixed seat with a movable pedal and resistance springs, and may be used to perform exercises in a seated position. The Reformer is another piece of equipment which utilizes spring resistance and which allows additional exercises to be performed, including exercises performed in the prone and supine positions (among others), in addition to exercises performed in a seated position. It would be desirable to provide a single piece of equipment which allows the user to perform the traditional, Pilates chair-based exercises as well as Reformer-based exercises and/or new or nontraditional exercises that cannot be performed on the prior art Pilates chairs.

SUMMARY

In one aspect, an exercise chair is provided comprising a frame and a seat rotatably coupled to the frame. First and second front support members are coupled to the frame in laterally spaced part relation. First and second rear support members are coupled to the frame in laterally spaced part relation. The first and second front support members and the first and second rear support members cooperate to support the frame above a surface.

In a more limited aspect, the first and second front support members and the first and second rear support members are removably attached to the frame.

In another, more limited aspect the exercise chair further includes one or more levers pivotally coupled to the exercise chair, the levers configured to be pressed down by a user seated on the seat.

In another more limited aspect, the exercise chair further comprises a rear support assembly which includes the first and second rear support members and one or more levers pivotally coupled to the first and second rear support members, the one or more levers configured to be pressed down by a user seated on the seat.

In still another more limited aspect, the rear support assembly has a pivot axle extending between the first and second rear support members and each of the one or more levers have a first end pivotally attached to the pivot axle and a pedal attached to a second end.

In yet another more limited aspect, the rear support assembly includes first and second levers pivotally attached to the rear support assembly.

In another more limited aspect, the rear support assembly includes a removable fastener for securing the first and second levers in a fixed, nonpivoting position relative to the first and second rear support members when the rear support assembly is removed from the frame.

In still another more limited aspect, the exercise chair herein further includes a first spring having a first end attached to the frame and a second end attached to the first lever and a second spring having a first end attached to the frame and a second end attached to the second lever.

In another more limited aspect, the rear support assembly is removably attached to the frame and is removable from the frame as an integral unit.

In yet another more limited aspect, the exercise chair herein further includes a first spring fastener attached to the first lever and a second spring fastener attached to the second lever. The second end of the first spring is attachable to the first spring fastener at a plurality of positions to vary the resistance of the first lever to downward movement. The second end of the second spring is attachable to the second spring fastener at a plurality of positions to vary the resistance of the second lever to downward movement.

In another more limited aspect, the exercise chair herein further includes third and fourth spring fasteners attached to the frame. The second end of the first spring is attachable to the third spring fastener and the second end of the second spring attachable to the fourth spring fastener to store the first and second springs in a stowed position.

In yet another more limited aspect, the exercise chair herein further includes a mechanical fastener removably attachable to the first and second levers for causing the first and second levers to pivot together as a unit.

In another more limited aspect, the frame has first and second front receptacles for removably attaching the first and second front support members and first and second rear receptacles for removably attaching the first and second rear support members.

In still another more limited aspect, the exercise chair herein further includes a fastener for selectively securing the seat in a fixed position relative to the frame.

In another more limited aspect, the exercise chair herein further includes one or more handles removably attached to the frame.

In still another more limited aspect, the exercise chair herein further includes one or more resistance elements including an elongate elastic band having a fastener at a first end for removable attachment to one or more of the first and second front support members and the first and second rear support elements.

In yet a further more limited embodiment, the seat is generally rectangular in shape, the seat having a length and a width, wherein the length is greater than the width.

In another more limited aspect, the first and second front support members and the first and second rear support members are extendable to support the seat at a plurality of heights above the surface.

In yet another more limited aspect, the exercise chair herein further includes a generally vertical seat back removably coupled to the frame.

In still another more limited aspect, the exercise chair herein further includes a height adjustable seat post for supporting the seat at a plurality of heights above the surface.

In a further aspect, a kit includes component parts capable of being packaged in a disassembled or partially disassembled form and of being assembled into an exercise chair. The kit includes a frame having a seat rotatably coupled thereto. First and second front support members are configured to be removably coupled to the frame and a rear support assembly including first and second rear support members configured to be removably coupled to the frame.

In a more limited aspect, the kit further includes a container for storing the component parts in disassembled or partially disassembled form.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

DESCRIPTION OF THE PREFERRED EMBODIMENTS

Figure 1:
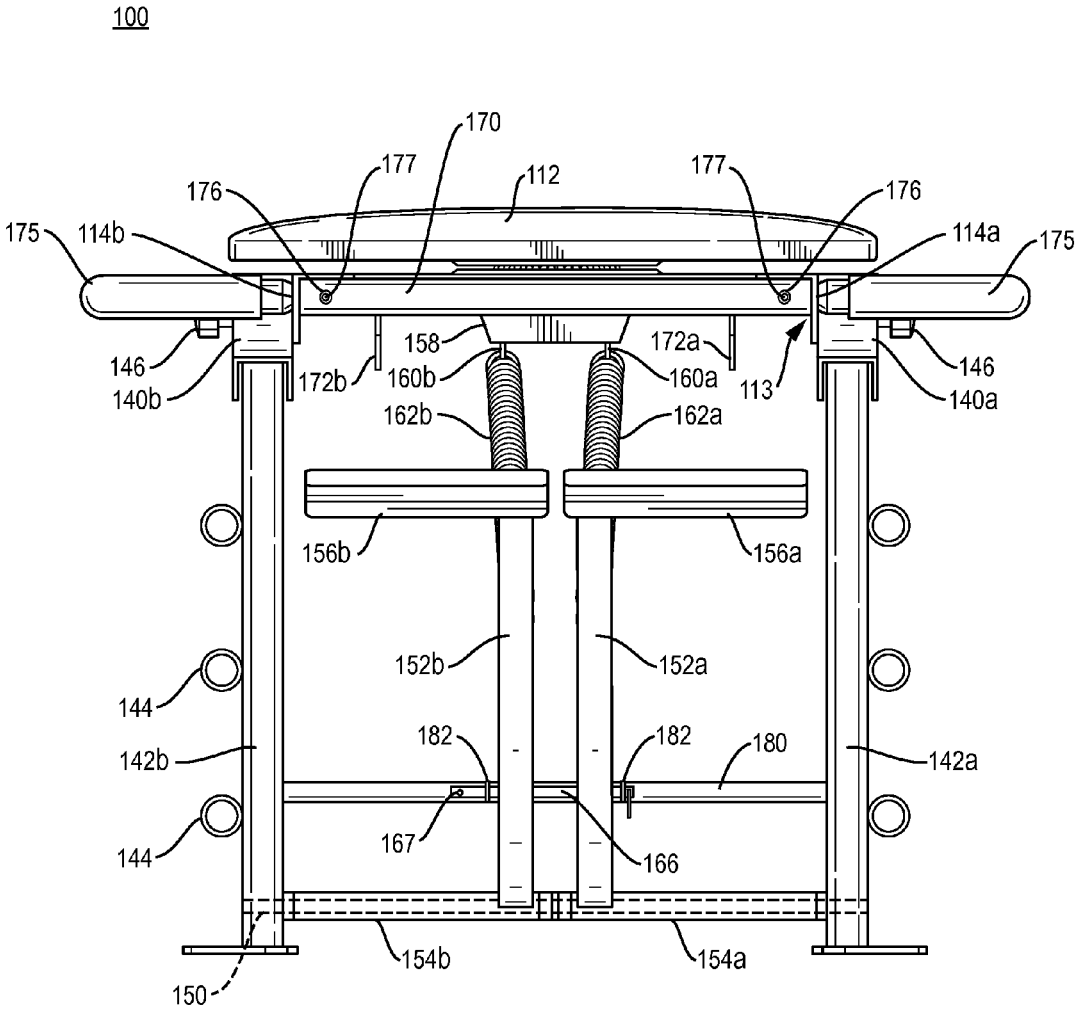
FIG. 1 is a front elevational view of a first exemplary embodiment of the invention.
Figure 2:
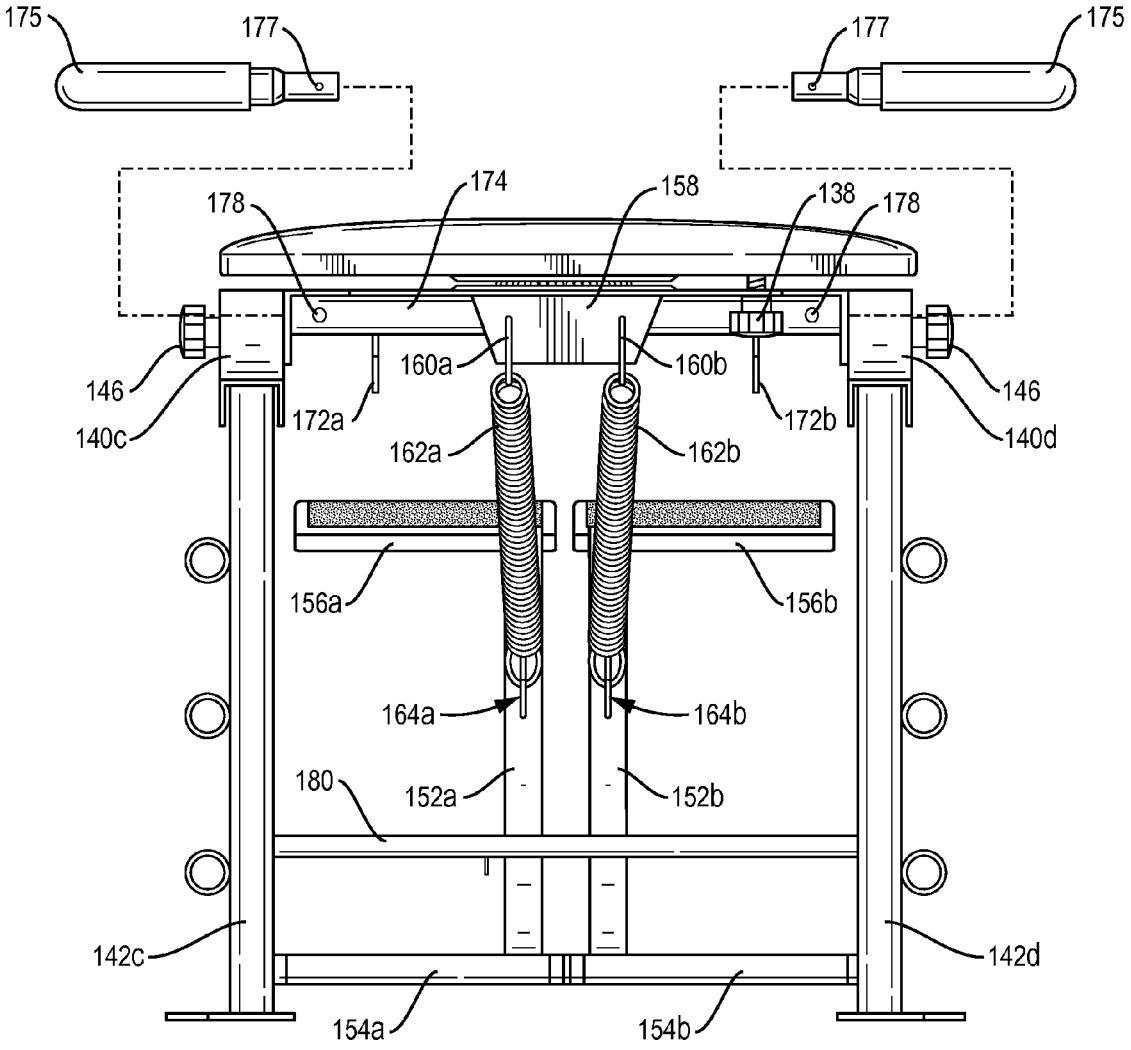
FIG. 2 is a partially exploded rear elevational view of the embodiment appearing in FIG. 1.
Figure 3:
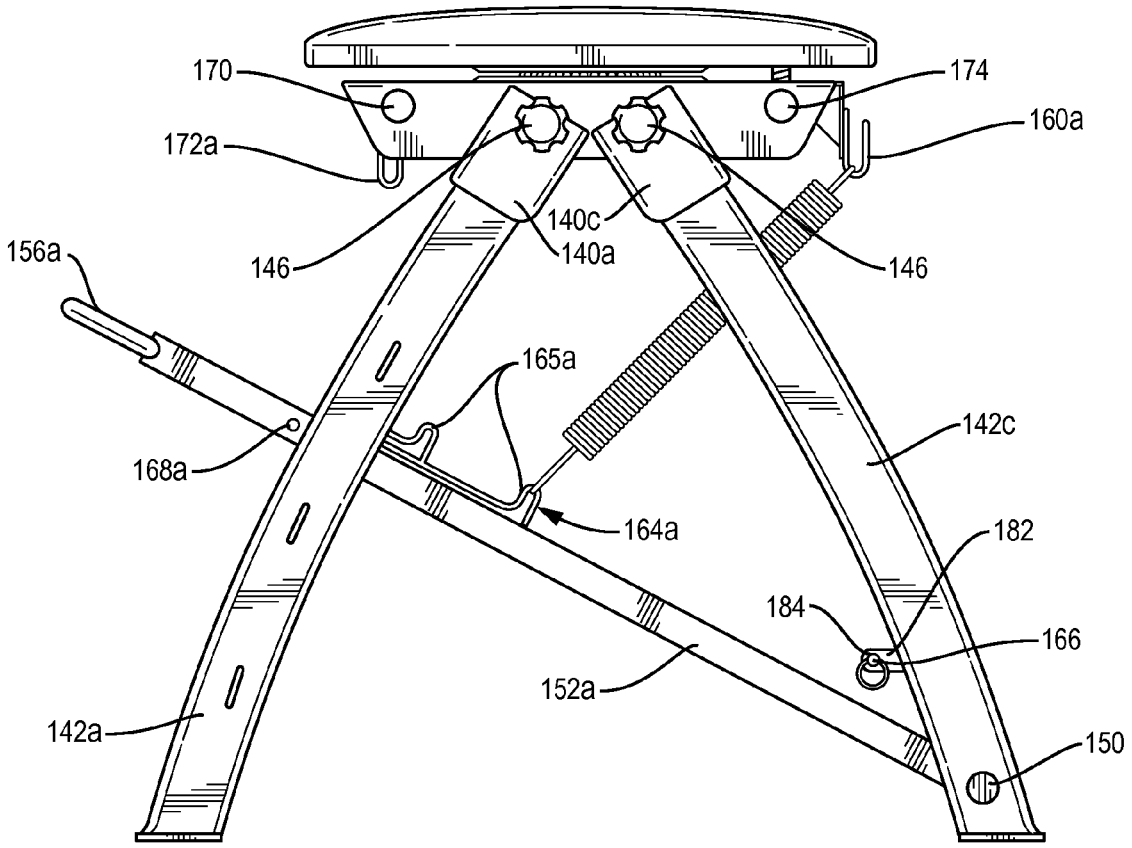
FIG. 3 is a right side elevational view of the embodiment appearing in FIG. 1, with the handles removed.
Figure 4:
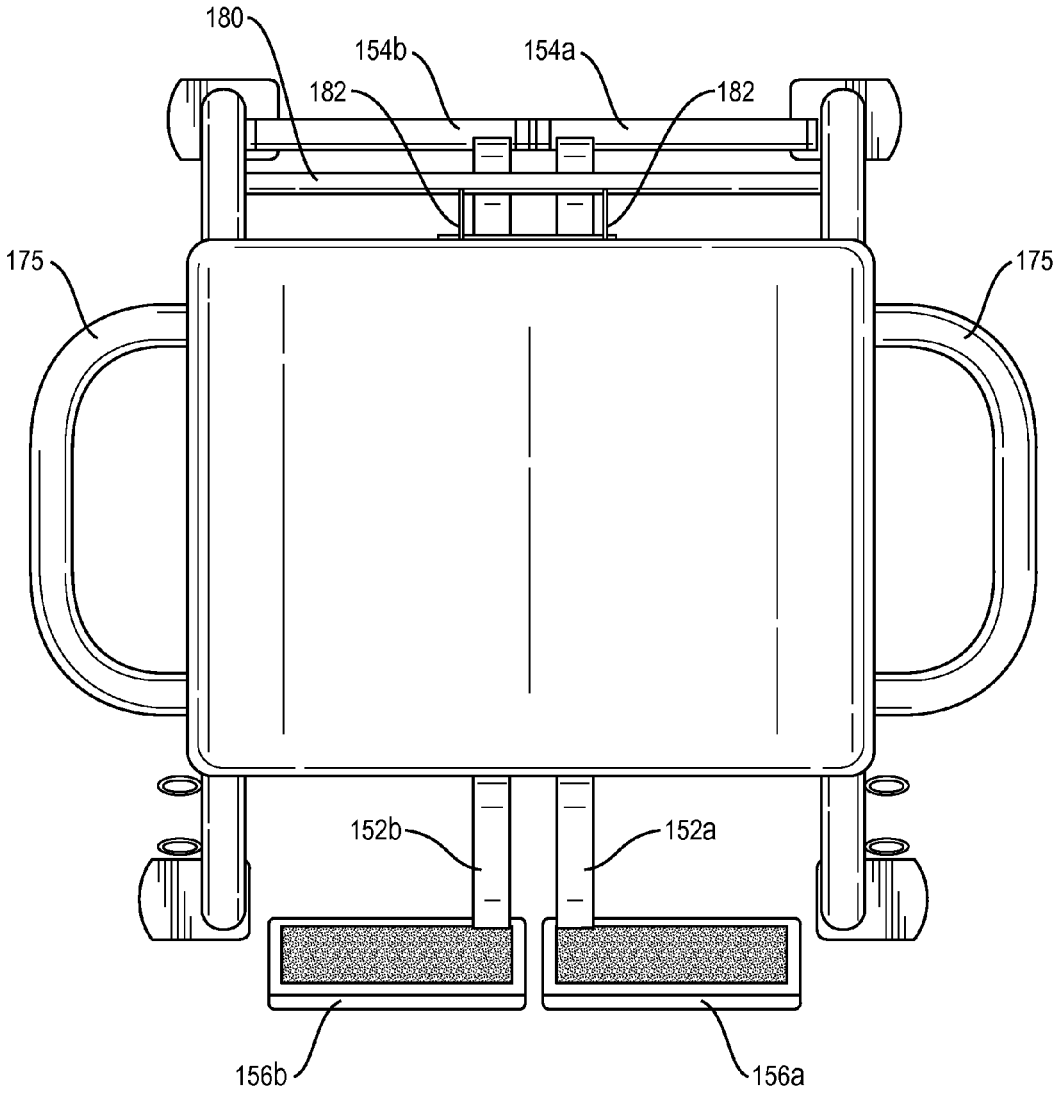
FIG. 4 is a top plan view of the embodiment appearing in FIG. 1.
Figure 5:
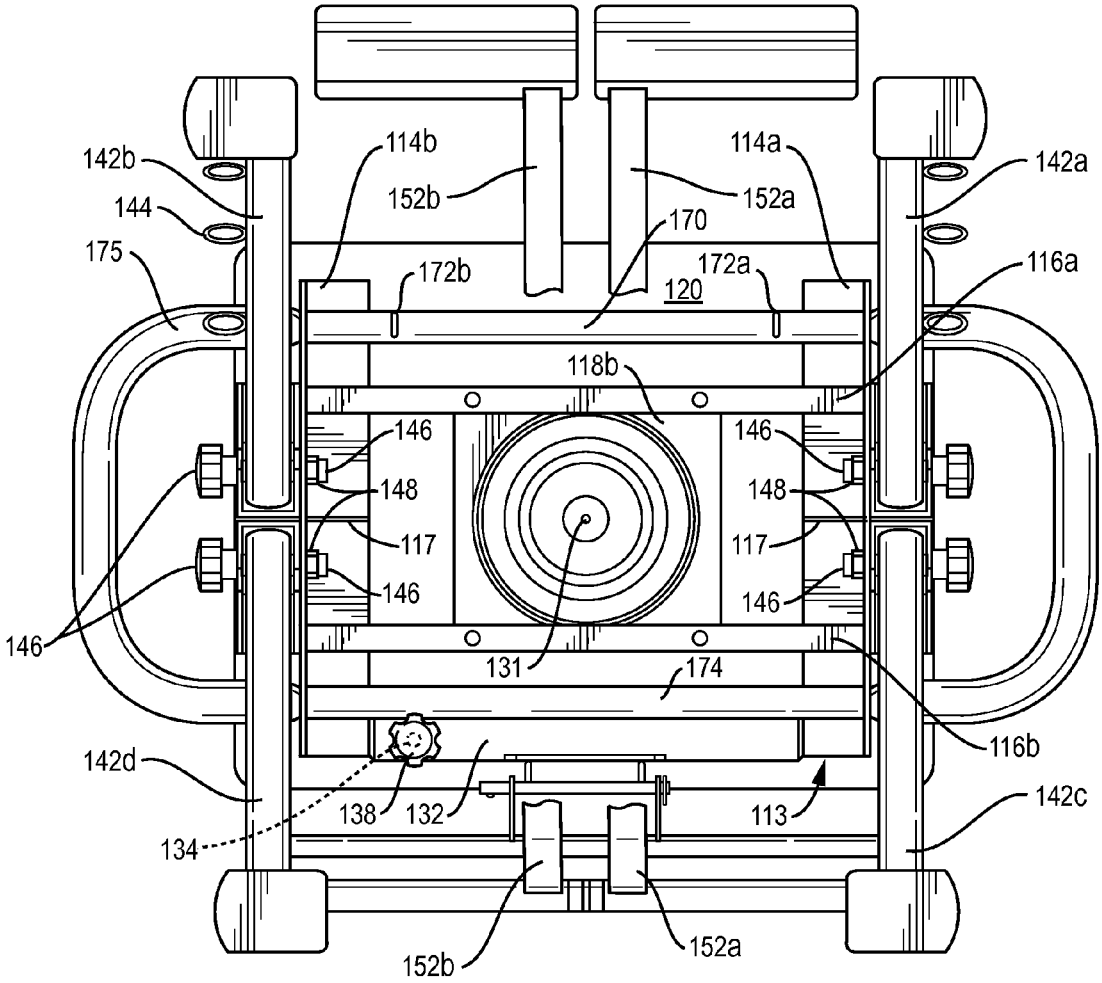
FIG. 5 is a partially cutaway bottom plan view of the embodiment appearing in FIG. 1.

Referring now to the drawings, where like reference numerals refer to like or analogous components throughout the several views, FIGS. 1-12 illustrate an exemplary exercise chair embodiment 100 with spin seat 112. The chair 100 includes a base frame assembly 113 comprising a left base frame member 114*a* and a right base frame member 114*b*, which extend in the axial direction and which are disposed on opposite transverse sides of the unit. Front and rear transverse seat frame members 116*a*, 116*b*, are secured to the base frame members 114*a*, 114*b*, e.g., via welding, although other fastening means including but not limited to bonding, gluing, or any other suitable method, such as threaded fasteners, clips, clamps, dogs, pawls, and so forth. In the depicted embodiment, the base frame members 114*a*, 114*b* have a generally L-shaped cross sectional shape, and may be reinforced with brace members 117.

Figure 6:
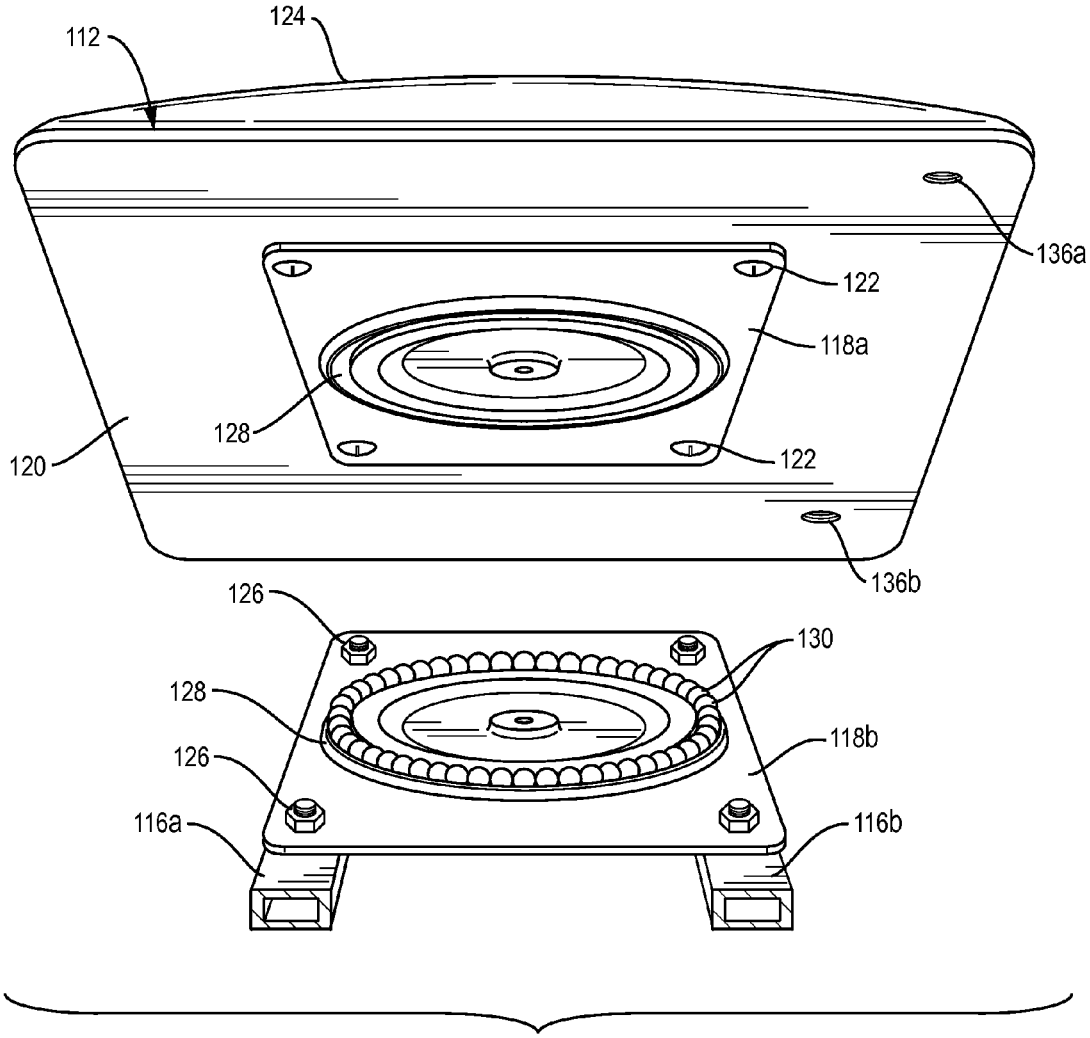
FIG. 6 is a partially exploded perspective view of the bearing assembly.

As best seen in FIG. 6, an upper swivel plate 118*a* is secured to the undersurface 120 of the seat 112, e.g., via threaded fasteners 122 located at the corners of the plate 118*a*. The seat 112 may be formed of wood or other rigid material. On the upper side 124 of the seat, a foam or other padding layer may be provided for comfort and an upholstery layer (e.g., vinyl, cloth, leather, etc.) may be provided to give a desired finished appearance.

A lower swivel plate 118*b* is secured to the transverse frame members 116*a*, 116*b*, e.g., via threaded fasteners 126. The plates 118*a*, 118*b* are disposed centrally and cooperate to define a race 128 for a plurality of ball bearings 130 therebetween. The upper and lower plates 118*a*, 118*b* are rotatably secured via a swivel pin 131.

With continued reference to FIGS. 1-12, a rear transverse frame member 132 extends between the left and right base frame members 114*a*, 114*b*. In the illustrated embodiment, an aperture 134 is formed in the rear transverse frame member 132. The aperture 134 is aligned with a corresponding first aperture 136*a* formed in the underside 120 of the seat 112 when the seat is positioned transversely as shown in FIG. 1. A threaded fastener 138 can be passed through the opening 134 in the frame and rotatably engaged with the opening 136*a* in the seat 112 to secure the seat in a fixed, transverse position, e.g., for chair based exercises.

In operation, the threaded fastener 138 can be removed, allowing the seat to spin through 360 degrees of rotation. By allowing the seat to swivel, new exercises may be performed. In alternative embodiments, the threaded fastener 138 may be replaced with an alternative seat locking member, such as a retention pin, which may advantageously be a quick release pin having a resilient protrusion engaging a complimentary depression. In still further embodiments, the seat locking member 138 may be tethered to the unit 100, e.g., the set frame assembly 113.

In the preferred embodiments, the seat 112 is generally rectangular and has one horizontal dimension which is greater than the other horizontal dimension, although embodiments with a square seat are also contemplated, as well as seats having other geometrical shapes. In the preferred embodiments illustrated, which have a rectangular seat with one dimension greater than the other, different exercises may be performed, depending on the orientation of the seat. For example, traditional Pilates chair exercises may be performed when the long dimension of the rectangular seat is oriented in the transverse direction of the exercise chair and reformer type exercises may be performed when the long dimension of the rectangular seat is oriented in the axial direction of the exercise chair.

Figure 7:
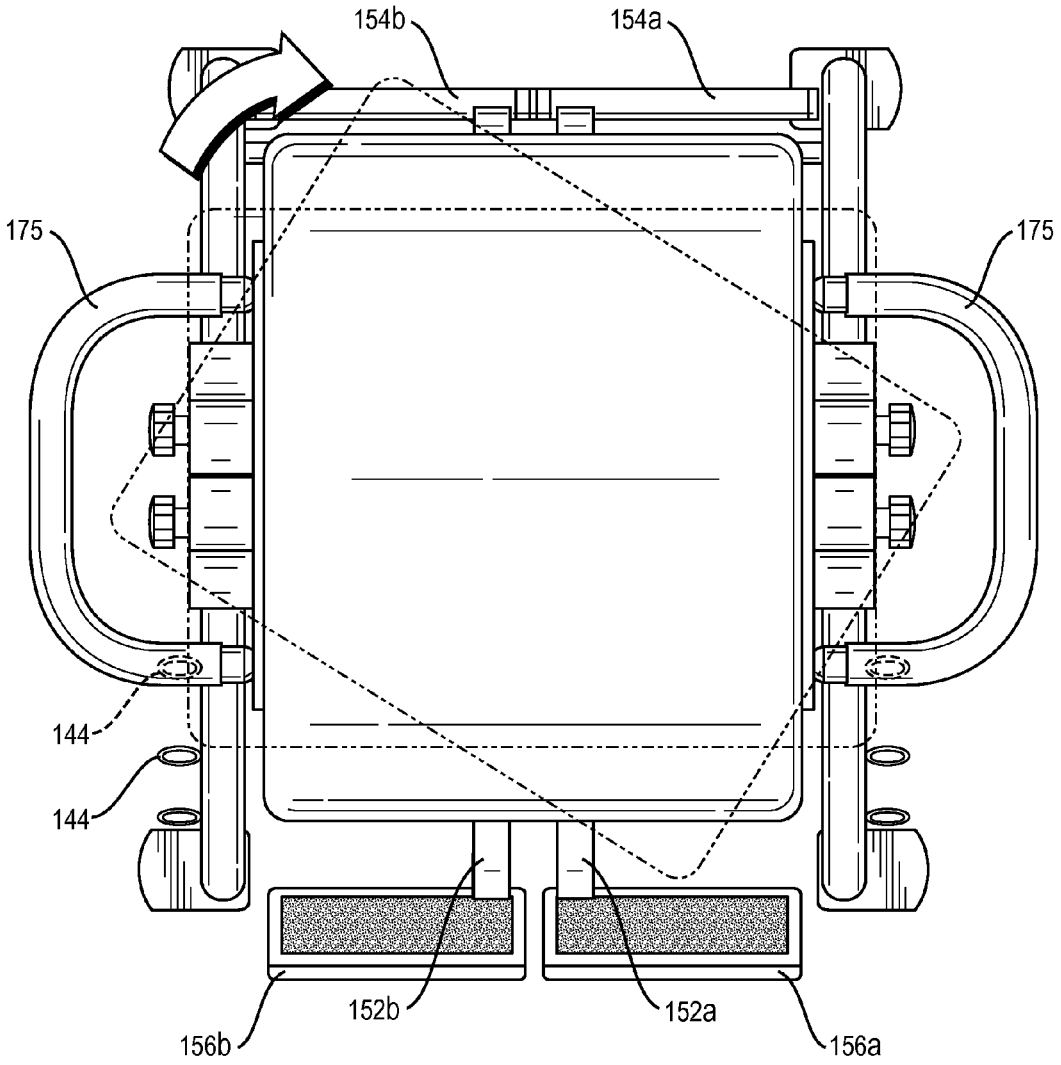
FIG. 7 is a top plan view of the embodiment appearing in FIG. 1, illustrating the manner of rotation of the seat from a transversely extending position to an axially extending position.

FIG. 7 illustrates the manner of rotating of the seat through 90 degrees. In FIG. 7, the seat is positioned axially, e.g., for reformer based exercises. Optionally, a second opening 136*b* may be formed on the undersurface 120 of the seat 112, which second opening is positioned thereon so as to be brought in alignment with the opening 134 in the transverse frame member 132 when the seat 112 is swiveled to the axial direction (see FIG. 6). In this manner, the fastener 138 can be used to lock the seat in the axial position, if desired.

Figure 11:
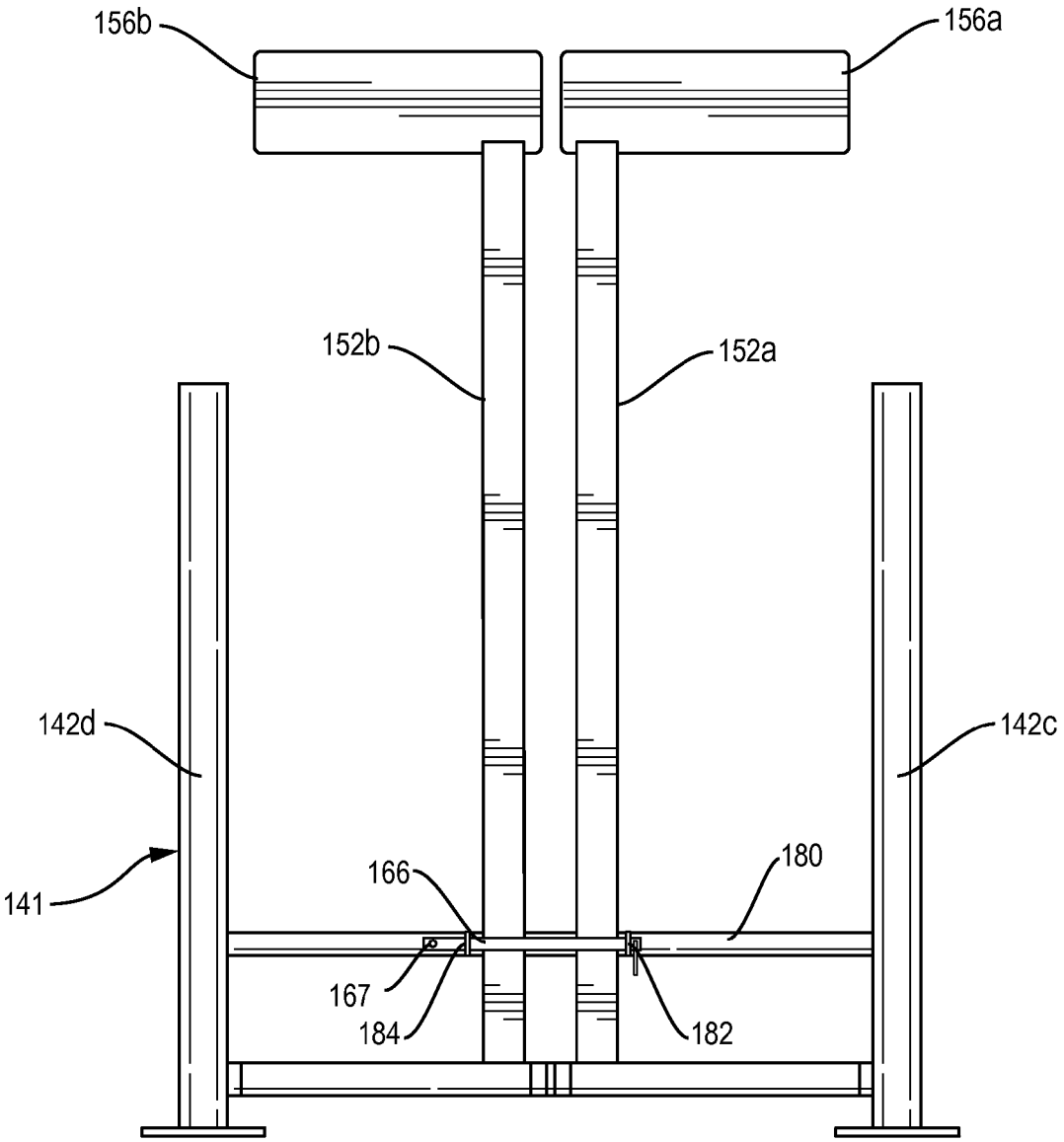
FIG. 11 illustrates the rear leg assembly in a disassembled state with the foot pedals locked in the stowed position.

The left and right base frame members 114*a*, 114*b*, include, respectively, left and right front receiver channels 140*a*, 140*b*, and left and right rear receiver channels 140*c*, 140*d*. The channel 140*a* receives a left front support member or leg 142*a* and the channel 140*b* receives a right front support member or leg 142*b*. The channel 140*c* receives a left rear support member or leg 142*c* and the channel 140*b* receives a right rear support member or leg 142*d*. Each of the front legs may include one or more eyelets 144 for attaching a resistance band or strap 151 for resistance band exercises. Preferably, each leg has a plurality of eyelets therealong, wherein the resistance may be varied by selecting different eyelets. As best seen in FIG. 11, the rear legs are formed as a part of a rear leg assembly 141 which can be removed from the frame as a unit.

Figure 8:
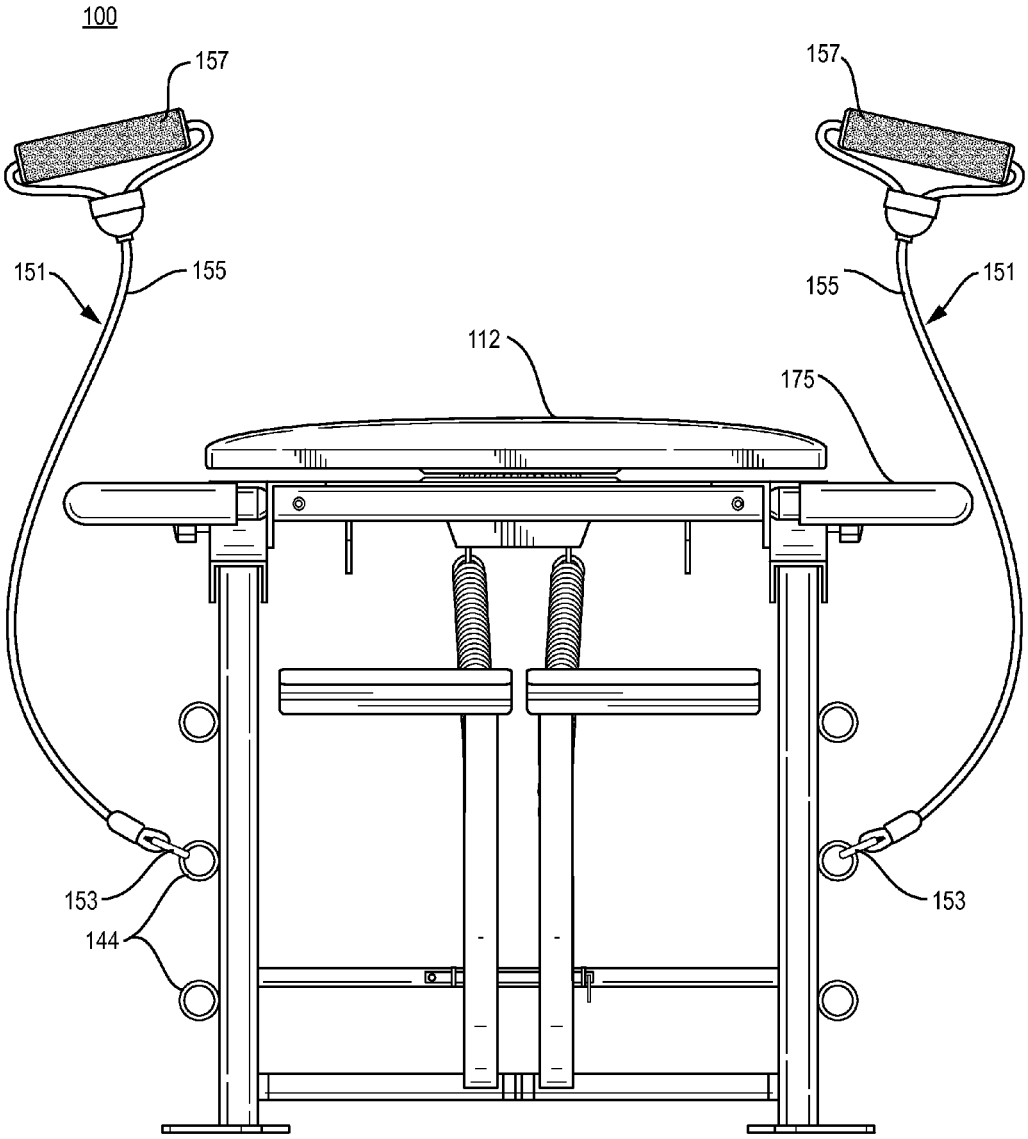
FIG. 8 is a front elevational view of the FIG. 1 embodiment having attached optional resistance bands.

As shown in FIG. 8, the resistance bands 151 include each include a proximal end having a fastener 153, such as a spring clip or other like fastener to removably attach the resistance bands to a selected one of the eyelets 144. A handle 157 is located at the distal end of the resistance bands 151 to allow the user to grasp the resistance band during use. Intermediate the fastener or clip 153 and the handle 157 is an elongate, elastic band 155, formed of an elastic material, such natural or synthetic rubber or an elastomer.

The bands 151 have a high degree of elasticity, which produces resistance as it is stretched by the movement of a particular training exercise. Regulation of the resistance can be varied based on user preference by securing the band to a selected on of the eyelets 144. For example, since the tension force generally increases the further the resistance band is stretched, the user may increase the resistance by attaching the end of the band 151 to a lower eyelet 144 and decrease resistance by attaching the band at a higher eyelet 144. Alternatively or additionally, the seat 100 herein may be provided with a kit having a plurality of bands (or more preferably, a plurality of pairs of bands) of different lengths and/or resistive forces for selection according to the desired degree of resistance, e.g., based on the size and/or strength of the user and/or the exercise to be performed.

In certain embodiments, the welded eyelets 144 could be replaced with alternative fasteners, such as hooks, clips, pins, a series of holes or openings formed in the legs, etc. In other embodiments, the bands 151 are attachable to a slide that is movable up or down the leg to vary the resistance. A fastener that is slidable is advantageous in that it can provide infinitely or continuously adjustable band resistance. For example, a sliding member may include a fastener such as a releasable clamp or cam lock that can be selectively released to allow the sliding member to be moved to a desired vertical position on the leg and locked to prevent the sliding member from moving during exercise. The slide can again be unlocked and moved to a new position when it is desired to move the slide to a different position. In certain embodiments, the bands 151 and/or eyelets 144 may be omitted.

Figure 9:
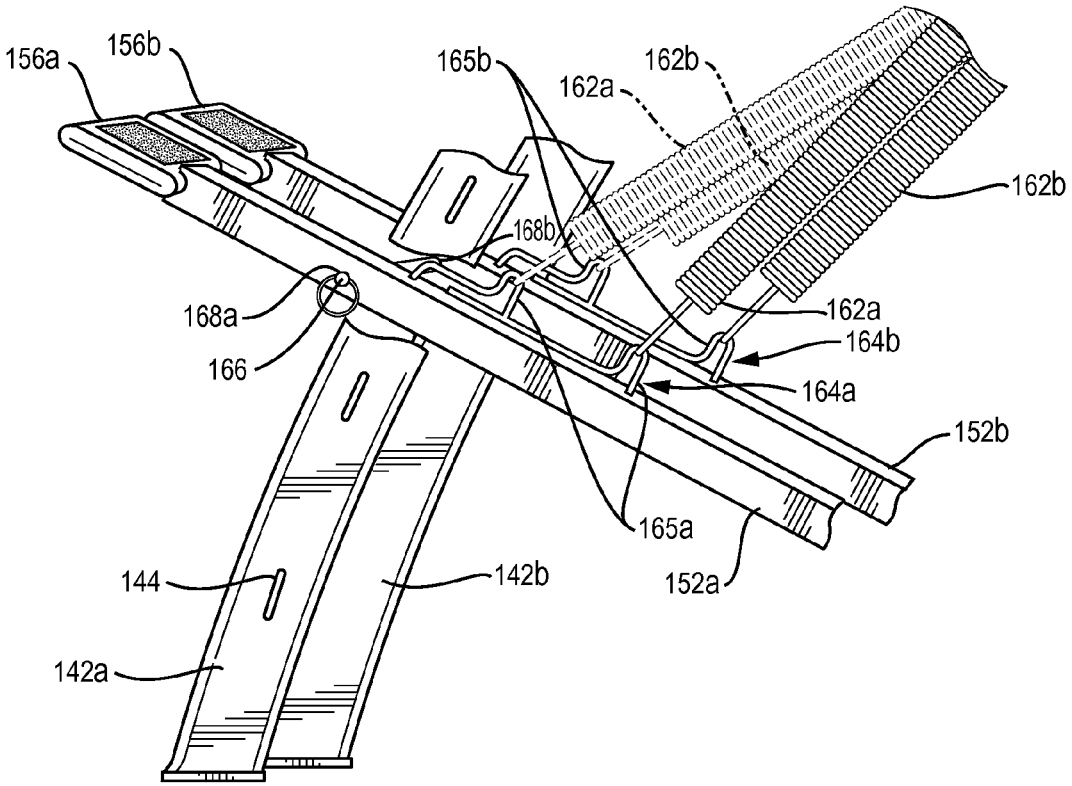
FIG. 9 is a partial perspective view illustrating spring attachment options the multiple spring attachment options.
Figure 10:
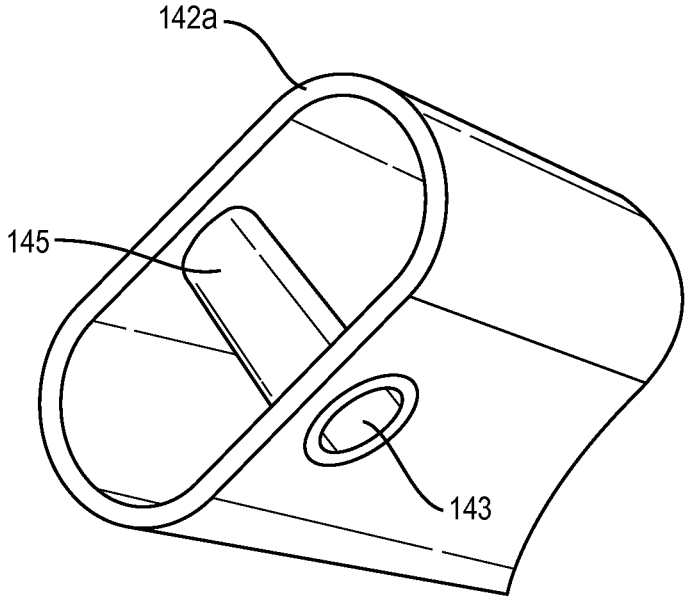
FIG. 10 is a partial perspective view of an exemplary removable leg.

Still referring to FIGS. 1-12, each of the receiver channels 140*a*-140*d* includes a pair of aligned openings, which are in alignment with a corresponding opening 143 in the leg. Where the leg is made of a tubular or hollow material, a sleeve or bushing 145 may be provided to provide a reinforced opening 143 for securing the leg to the frame. FIG. 10 shows the proximal end of the leg 142*a*. The ends of the other legs are similarly constructed. Threaded rods 146 pass therethrough and rotatably engage a corresponding threaded nut 148. Preferably, the nuts 148 are each permanently attached to a corresponding one of the receiver channels 140*a*-140*d*, e.g., via welding. The threaded rods 146 are manually removable by the user to disassemble the unit 100 as detailed below. In alternative embodiments, retaining pins or the like may be used in place of the threaded rods 146. In one embodiment, captured spring pins are contemplated for use in place of the threaded rods 146, wherein a spring loaded pin having a captured spring urges the pin into the opening 143 and wherein the pin may be disengaged from the opening by manually pulling out the threaded rods against the bias of the captured spring a distance to remove or attach the legs, as would be under stood by persons skilled in the art.

Although a generally tubular or hollow leg construction is generally preferred, it will be recognized that the legs may be formed of any hollow of solid material, including without limitation woods, metals/metal alloys, plastics, composite materials, and so forth. Similarly, the base frame is depicted as being of a generally metal construction, although all manner of materials, including wood, metal/alloy, plastic, composite materials and so forth.

The rear legs 142*c*, 142*d* are transversely connected via a pivot bar or axle 150. Left and right foot levers or bars 152*a*, 152*b* each include a respective pivot sleeve 154*a*, 154*b*, located at the proximal end thereof and which receive the pivot axle 150 to allow independent pivoting movement of the foot bars about the axle 150. The distal ends of the foot bars 152*a*, 152*b* include respective left and right foot pedals 156*a*, 156*b* for operation of the foot bars, e.g., with the feet or other body part of the user.

Although, the present invention is shown with dual (i.e., split) foot pedals, it will be recognized that the dual pedal system illustrated could be replaced with a single foot pedal or lever, as with the original Pilates (Wunda) chair. In an especially preferred embodiment, the levers 152*a*, 152*b* include an opening for receiving a retaining pin or clip to lock the two legs together for use in tandem to allow the user selectively use the pedals independently or in tandem. For example, as best seen in FIG. 9, the retaining pin 166, discussed below, could be removed from the rear leg assembly and inserted through the aligned openings 168*a*, 168*b* in the foot bars 152*a*, 152*b* to lock the foot bars together, although it is also contemplated that a separate pin could also be provided.

Although the term "foot bars" and "foot pedals" are used for ease of exposition, it will be recognized that their use is not limited to operation with the users feet, and the foot pedals may be operated any other part of the user's body, including hands, arms, legs, knees, and so forth.

A front hollow tube member 170 extends transversely between the left and right base frame members 114*a*, 114*b*. Left and right hooks 172*a*, 172*b* are secured to the tube 170 and may be used to secure the end of the springs when the springs are detached from the leg bars 152*a*, 152*b* when the unit 100 is not in use (see FIG. 12).

A rear hollow tube member 174 transversely between the left and right base frame members 114*a*, 114*b*. The tubes 170, 174 extend through aligned openings in the base frame members and allow the user to removably attach a handle 175 to each side of the unit. An exemplary handle shape is shown in the illustrated embodiment herein. It will be recognized, however, that different handle configurations may be employed or that a kit may be provided with a plurality of handles of different heights, shapes, and so forth.

In certain embodiments, the handles could be permanently attached to the chair. In other embodiments, the handles may be omitted.

The ends of the handles 175 are sized to be telescopically received in the tubes 170 and 174. Openings 176 in the front tube 170 and openings 178 in the rear tube 174 provide for positive retention of the handles 175 in the tubes, e.g., through the use of a spring biased pin or protrusion 177 in the portion of the handle that is received in the tube, which biased pin, ball, or other resilient protrusion engages the corresponding one of the openings 176, 178 when the handles have been properly inserted into the tubes 176, 178. The tubes 176, 178 could also be used to secure other accessories, such as an arched member allowing the user to perform ladder barrel exercises, among others.

The rear leg assembly 141 further includes a leg retention bar 180, which extends transversely between the rear legs 142*c*, 142*d*. In operation, when the rear legs 142*c*, 142*d* are removed from the corresponding channels 140*c*, 140*d*, respectively, the legs 142*c*, 142*d* may be pivoted upward about the pivot axle 150 until they are adjacent to the bar 180, passing in between a pair of arms 182 extending from the bar 180. The pin 166 is passed through aligned openings 184 in the arms 182, thereby securing the foot bars 152*a*, 152*b* in fixed position relative to the legs 142*c*, 142*d*. The pin 166 includes a resilient protrusion 167 to prevent inadvertent removal of the pin.

The rear transverse frame member 132 includes a vertically extending reinforcement plate 158 centrally disposed thereon. Left and right hooks 160*a*, 160*b* are attached thereto. Left and right spring members 162*a*, 162*b* each have a first end attached to the corresponding one of the hooks 160*a*, 160*b* and a second end attached to corresponding loop 164*a*, 164*b* on the foot bars 152*a*, 152*b*. Although coils springs are depicted in the illustrated embodiment, it will be recognized that other types of spring elements 162*a*, 162*b* may be employed, such as elastic cords or cables, flexible rods, leaf springs, pistons, and the like.

In the depicted embodiment, the loops 164*a*, 164*b* have a plurality of notches or recesses 165*a*, 165*b*, respectively, to allow varying the resistance, tension, or leverage of the springs and/or varying the position or range of motion of the foot pedals. Alternatively, the notched loops 164*a*, 164*b* could be replaced with one or more (and preferably a series of two or more) eyelets; a welded plate with one and preferably a plurality of holes formed therein; one or preferably two or more holes formed directly in the foot bars; etc. It is also contemplated that a plurality of spring sizes could be provided, and the resistance could be varied by selecting springs with a desired resistance or spring force.

The unit 100 may be disassembled for easy transport, by removing the threaded rods 146 from each of the leg receptacles 140*a*-140*d*, and removing the individual front legs 142*a*, 142*b*, and removing the rear legs 142*c*, 142*d*, which remain attached as an assembly also comprising the foot bars 152*a*, 152*b*. The foot bars 152*a*, 152*b* are pivoted until they are received between the arms 182 and the pin 166 is passed through the openings 184 to secure the leg bars in place, as shown in FIG. 11.

Figure 12:
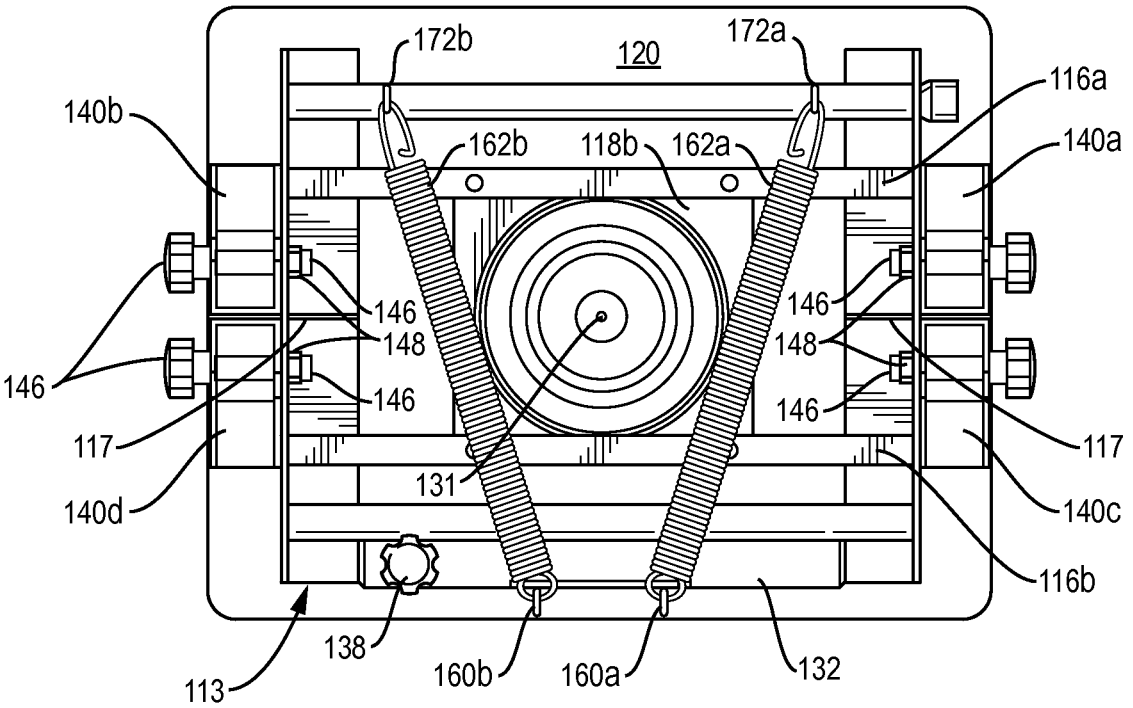
FIG. 12 illustrates the seat assembly in a disassembled stated with the pedal springs in a stowed position.

As shown in FIG. 12, when the legs 142*a*-142*d* are removed from the frame assembly 113, the seat assembly 112 and frame assembly 113 can be transported or stored as a relatively flat and compact assembly. The spring members 162*a*, 162*b* can be stored with the seat/frame assembly when a first end of the springs is attached to the respective front hook 172*a*, 172*b* and a second end of the springs is attached to the respective rear hook 160*a*, 160*b*.

As can be seen in FIGS. 11 and 12, disassembly in this manner results in discrete and relatively compact subassemblies, including the base frame 113 with the seat 112, the rear leg assembly 141, and the two front legs 142*a*, 142*b*. Thus, the present development also contemplates a kit having component parts capable of being packaged, shipped, stored, etc. in a disassembled or partially disassembled form and of being assembled into an exercise chair. The kit may include a container such as a bag, case, or the like for storing and transporting the components in the disassembled state, as well as any accessories, such as the handles, resistance bands, and so forth.

Figure 13:
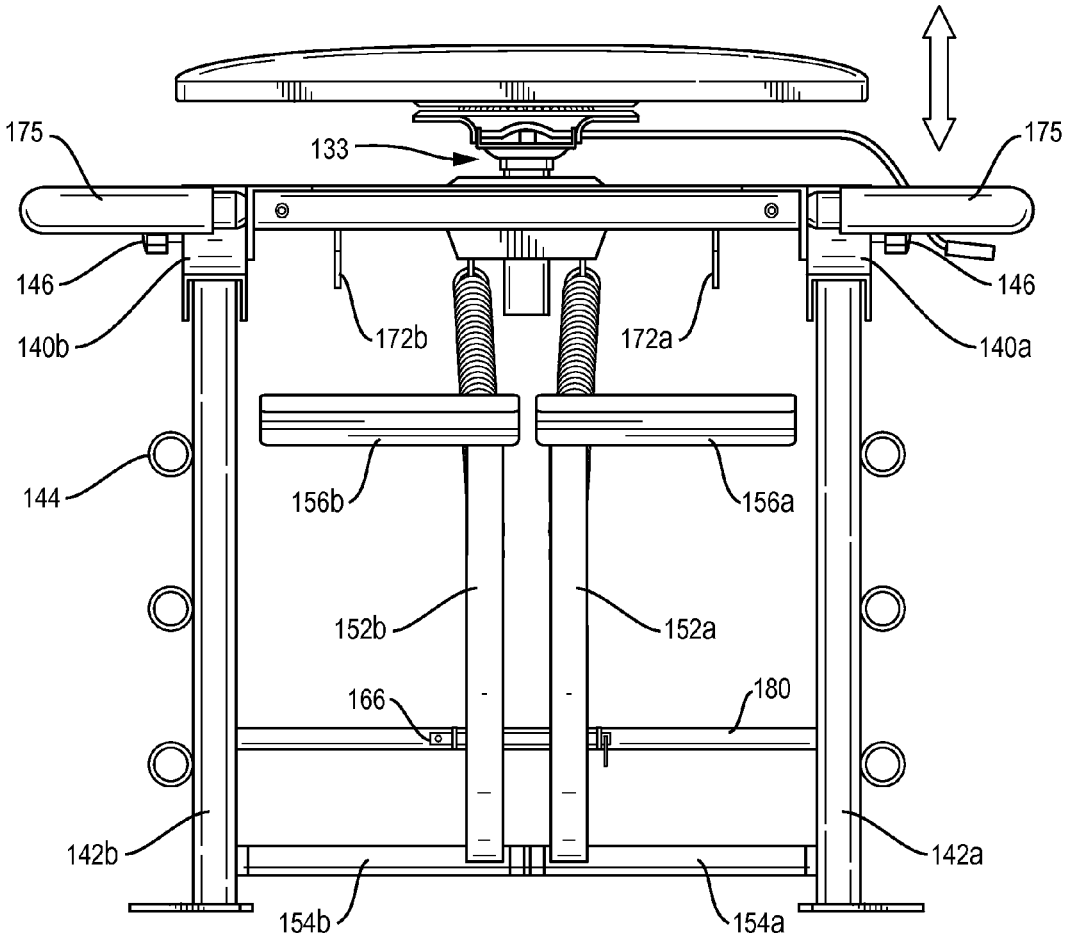
FIG. 13 is a front elevational view of a second exemplary embodiment of the invention having a height adjustable seat assembly.

In alternative embodiments, as shown in FIG. 13, the bearing swivel assembly could be replaced with a swiveling, telescoping post 133, such as a pneumatically activated seat post that provides a height adjustable seat surface. The height adjustable seat assembly 133 may be with or without swivel capability, and most preferably provides swivel capability. In certain embodiments, a height adjust mechanism 133 provides a swivel capability with a user selectable locking mechanism to selectively lock the seat in place when a swiveling seat is not desired for a particular exercise. In still further embodiments, a non-swiveling seat may be provided, e.g., by securing the seat member 112 directly to the base frame 113. The embodiment of FIG. 13 may be as otherwise described herein by way of reference to the exercise chair 100.

Figure 14:
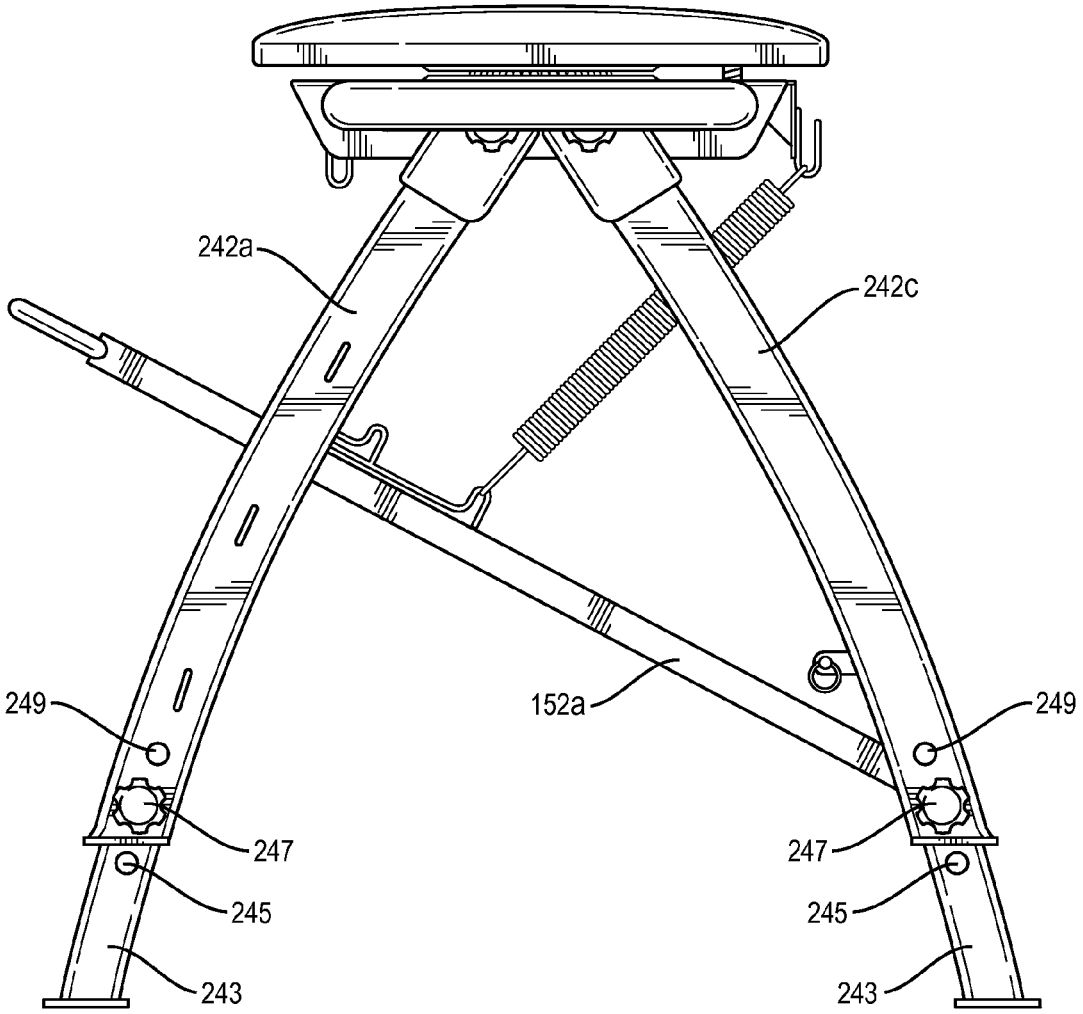
FIG. 14 is a side elevational view of a third exemplary embodiment of the invention having height adjustable legs.

Referring now to FIG. 14, in still further embodiments, an exercise chair may be as otherwise as described herein but wherein the legs 142*a*-142*d* herein are replaced with a pair of transversely spaced apart height adjustable front legs 242*a* and a pair of transversely spaced apart height adjustable rear legs 242*c*. In the illustrated embodiment, the legs each have one or more openings 249 and further include a lower telescoping member 243 having a plurality of openings 245 spaced along its length. To adjust the height, one of the openings 249 is aligned with one of the openings 245 to achieve a selected height. A fastener 247, which may be a threaded fastener, pin, or the like, is passed through the aligned ones of the openings 245 and 249 to secure the telescoping members in the desired position. In alternative embodiments, the telescoping member may be provided at the upper end of the leg members rather than at the lower portion. In still further embodiments, the telescoping legs as described herein may also be employed in conjunction with the pneumatic seat height adjustment as described above by way of reference to FIG. 13.

Figure 15:
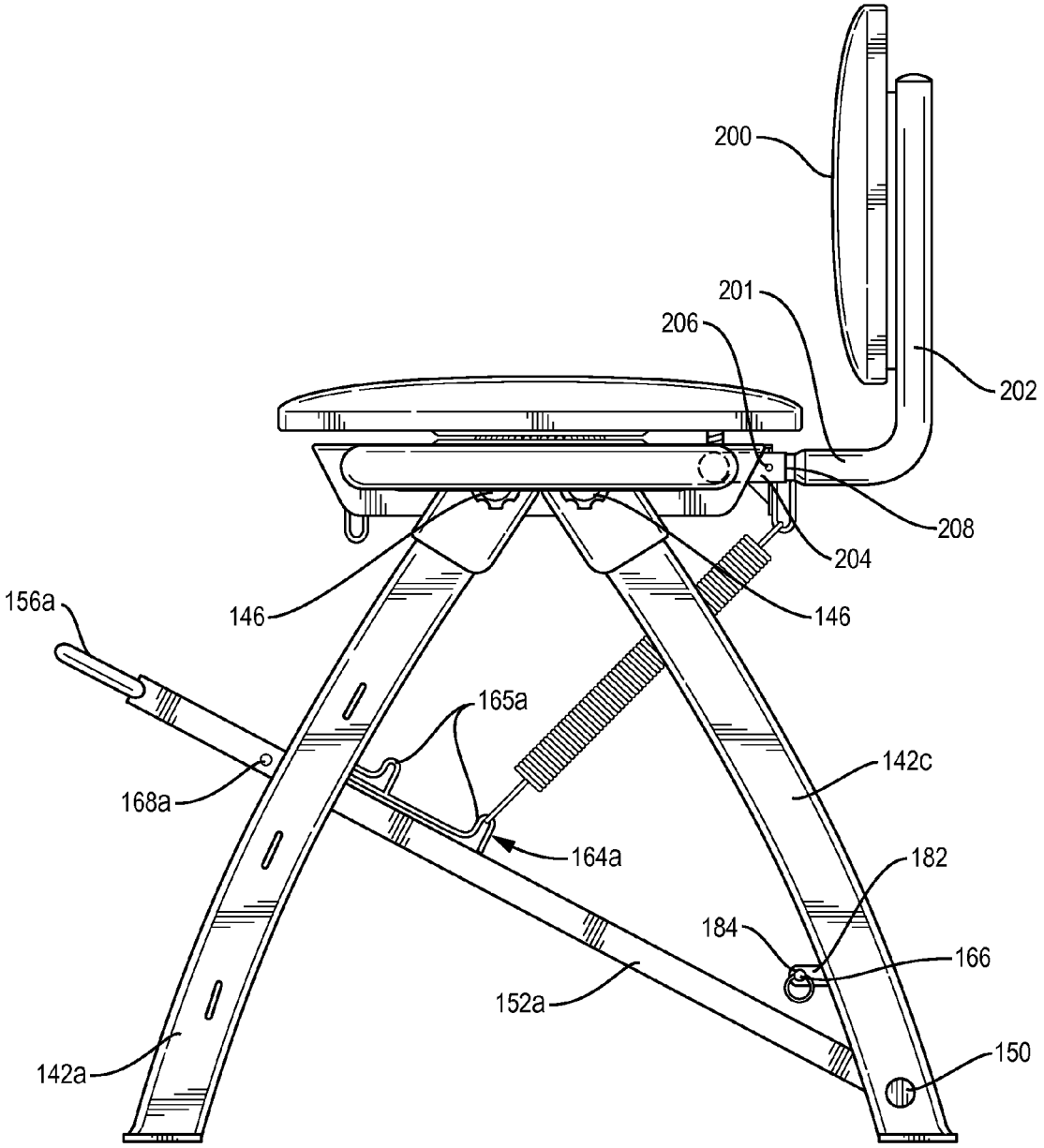
FIG. 15 is a side elevational view of a fourth exemplary embodiment of the invention having a removable seat back.

Referring now to FIG. 15, there is shown a further embodiment exercise chair having a removable seat back 200. The seat back 200 may be employed to provide back support to a user who desires to sit on the exercise chair for extended period of time, for example, for use as an office chair or for other conventional chair usage. In the illustrated embodiment the seat back 200 includes a pair of support members each having a proximal end 201 removably secured within a hollow receptacle 204 and a distal end 202 secured to the seat back 200. A resilient protrusion 206 engages an aligned opening in the receptacle 204 to provide removable yet secure retention of the seat back 200 on the exercise chair. In still further embodiments, the seat back 200 may be provided in conjunction with the telescoping legs as described above by way of reference to FIG. 14 and/or pneumatic seat height adjustment as described above by way of reference to FIG. 13.

The invention has been described with reference to the preferred embodiments. Modifications and alterations will occur to others upon a reading and understanding of the preceding detailed description. It is intended that the invention be construed as including all such modifications and alterations.

What is claimed is:

1. An exercise chair comprising:

a frame having a pair of spaced apart rails and a seat support member extending between the rails;

a seat assembly having a seat member and a bearing assembly, wherein the seat assembly is coupled directly to the seat support member and the seat member is rotatable about a vertical spin axis;

first and second front support members coupled to the frame in laterally spaced apart relation;

first and second rear support members coupled to the frame in laterally spaced part relation, wherein the first and second front support members and the first and second rear support members support the frame above a surface; and a foot-actuated lever pivotally coupled to the exercise chair and configured to provide resistance when pressed down by a user seated on the seat.

2. The exercise chair of claim 1, wherein the first and second front support members and the first and second rear support members are removably attached to the frame.

3. The exercise chair of claim 1, wherein either the first or second rear support member, or both, are pivotally coupled to the foot-actuated lever, and wherein the first and second rear support members and the foot-actuated lever together define a rear support assembly.

4. The exercise chair of claim 3, further wherein the rear support assembly has a pivot axle extending between the first and second rear support members, and wherein the foot-actuated lever has a first end pivotally attached to the pivot axle and a second end attached to a pedal.

5. The exercise chair of claim 3, further comprising a second foot-actuated lever, wherein the rear support assembly includes a removable fastener configured to secure the first and second foot-actuated levers in a fixed, nonpivoting position relative to the first and second rear support members when the rear support assembly is removed from the frame.

6. The exercise chair of claim 3, further comprising:

a second foot-actuated lever;

a first spring having a first end attached to the frame and a second end attached to the first foot-actuated lever; and a second spring having a first end attached to the frame and a second end attached to the second foot-actuated lever.

7. The exercise chair of claim 3, wherein the rear support assembly is removably attached to the frame and is removable from the frame as an integral unit.

8. The exercise chair of claim 6, further comprising:

a first spring fastener attached to the first foot-actuated lever; and a second spring fastener attached to the second foot-actuated lever, wherein the second end of the first spring is attachable to the first spring fastener at a plurality of positions to vary the resistance resulting from downward movement of the first foot-actuated lever, and wherein the second end of the second spring is attachable to the second spring fastener at a plurality of positions to vary the resistance resulting from downward movement of the second foot-actuated lever.

9. The exercise chair of claim 8, further comprising:

third and fourth spring fasteners attached to the frame;

wherein the second end of the first spring is attachable to the third spring fastener and the second end of the second spring is attachable to the fourth spring fastener to place the first and second springs in a stowed position.

10. The exercise chair of claim 6, further comprising a mechanical fastener, removably attachable to the first and second foot-actuated levers for causing the first and second foot-actuated levers to pivot together as a unit.

11. The exercise chair of claim 1, wherein the frame has first and second front receptacles for removably attaching the first and second front support members; and the frame has first and second rear receptacles for removably attaching the first and second rear support members.

12. The exercise chair of claim 1, further comprising:

a fastener, removably connected to the frame and the seat for selectively securing the seat in a fixed position relative to the frame.

13. The exercise chair of claim 1, further comprising:

a handle removably attached to the frame;

or a resistance element including an elongate elastic band having a fastener at a first end for removable attachment to one of the first and second front support members and the first and second rear support elements.

14. The exercise chair of claim 1, wherein the seat is generally rectangular in shape, and the seat has a length and a width wherein the length is greater than the width.

15. The exercise chair of claim 1, wherein said first and second front support members and said first and second rear support members are extendable to support the seat at a plurality of heights above the surface.

16. The exercise chair of claim 1, further comprising a generally vertical seat back removably coupled to the frame.

17. The exercise chair of claim 1, further comprising a height adjustable seat post for supporting the seat at a plurality of heights above the surface.

18. A kit having component parts capable of being packaged in a disassembled or partially disassembled form and of being assembled into an exercise chair, the kit comprising:

a frame comprising a pair of spaced apart rails and a seat support member extending between the rails, the frame having a seat assembly attached directly to the seat support member, the seat assembly including a seat member and a bearing assembly, wherein the seat member is rotatable about a vertical spin axis;

first and second front support members configured to be removably coupled to the frame;

a rear support assembly including first and second rear support members configured to be removably coupled to the frame; and a foot-actuated lever pivotally coupled to the exercise chair, the foot-actuated lever configured to provide resistance when pressed down by a user seated on the seat.

19. The kit of claim 18, further comprising a container for storing the component parts in disassembled or partially disassembled form.

* * * * *